US012172060B2

(12) United States Patent
Andrews et al.

(10) Patent No.: US 12,172,060 B2
(45) **Date of Patent: *Dec. 24, 2024**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Matthew T. Andrews, Scottsdale, AZ (US); Robert R. Parsons, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/778,133

(22) Filed: Jul. 19, 2024

(65) Prior Publication Data

US 2024/0367015 A1 Nov. 7, 2024

Related U.S. Application Data

(63) Continuation of application No. 18/621,629, filed on Mar. 29, 2024, now Pat. No. 12,076,625, which is a (Continued)

(51) Int. Cl.
*A63B 47/02* (2006.01)
*A63B 53/04* (2015.01)
(Continued)

(52) U.S. Cl.
CPC ..... *A63B 53/0487* (2013.01); *A63B 53/065* (2013.01); *A63B 60/02* (2015.10);
(Continued)

(58) Field of Classification Search
CPC ..... A63B 47/02; A63B 53/04
(Continued)

(56) References Cited

U.S. PATENT DOCUMENTS 807,224 A 12/1905 Vaile
922,444 A 5/1909 John
(Continued)

FOREIGN PATENT DOCUMENTS

FR 2834647 A1 7/2003
GB 2357251 A 6/2001
(Continued)

*Primary Examiner* — Alvin A Hunter

(57) ABSTRACT

Embodiments of golf club heads and methods to manufacture golf club heads are generally described herein. In one example, a golf club head includes a body portion having a toe portion, a heel portion, a front portion, a rear portion, a top portion, and a sole portion. A retention cavity is located at the sole portion and includes an opening and a plurality of interior side walls connected to the opening. The plurality of interior side walls define two or more ball retention areas configured to frictionally engage at least a portion of a golf ball within the retention cavity. The two or more ball retention areas are located at or proximate the opening and frictionally engage the golf ball along a ball circumference located above an equator of the golf ball. Other examples and embodiments may be described and claimed.

20 Claims, 14 Drawing Sheets

Related U.S. Application Data continuation-in-part of application No. 18/385,952, filed on Nov. 1, 2023, now Pat. No. 12,011,644, which is a continuation of application No. 18/219,215, filed on Jul. 7, 2023, now Pat. No. 11,839,801, said application No. 18/621,629 is a continuation-in-part of application No. 18/102,534, filed on Jan. 27, 2023.

(60) Provisional application No. 63/619,405, filed on Jan. 10, 2024, provisional application No. 63/612,481, filed on Dec. 20, 2023, provisional application No. 63/524,452, filed on Jun. 30, 2023, provisional application No. 63/470,711, filed on Jun. 2, 2023, provisional application No. 63/402,587, filed on Aug. 31, 2022, provisional application No. 63/390,206, filed on Jul. 18, 2022.

(51) Int. Cl.
*A63B 53/06* (2015.01)
*A63B 60/02* (2015.01)

(52) U.S. Cl.
CPC ..... *A63B 53/0408* (2020.08); *A63B 53/0437* (2020.08); *A63B 53/0441* (2020.08); *A63B 53/0466* (2013.01); *A63B 53/047* (2013.01); *A63B 2053/0491* (2013.01)

(58) Field of Classification Search
USPC ..... 294/19.2
See application file for complete search history.

(56) References Cited

U.S. PATENT DOCUMENTS

RE19,178 E 5/1934 Spiker
1,960,110 A * 5/1934 Iles ..... A63B 47/02 473/286
2,213,190 A * 9/1940 Haverbach ..... A63B 47/02 473/286
2,814,520 A * 11/1957 Ruhland ..... A63B 47/02 D21/721
3,136,573 A * 6/1964 Harke ..... A63B 47/02 294/99.1
3,300,241 A * 1/1967 Eberwein ..... A63B 47/02 473/286
3,374,027 A * 3/1968 Jacobs ..... A63B 47/02 473/286
D216,138 S * 11/1969 Carignan ..... 473/286
3,497,220 A 2/1970 Scott
3,558,170 A * 1/1971 Stanworth ..... A63B 47/02 294/19.2
3,632,112 A * 1/1972 Jacobs ..... A63B 47/02 473/286
3,749,408 A 7/1973 Mills
3,841,639 A * 10/1974 Werner ..... A63B 47/02 473/286
4,043,562 A 8/1977 Shillington
4,114,881 A * 9/1978 Norton ..... A63B 49/08 473/517
4,163,554 A 8/1979 Bernhardt
4,248,430 A * 2/1981 Kepler ..... A63B 53/007 473/285
4,265,451 A 5/1981 Bernhardt
4,334,707 A * 6/1982 Phillips ..... A63B 47/02 294/19.2
4,340,230 A 7/1982 Churchward
4,493,503 A * 1/1985 Jeninga ..... A63B 47/02 294/19.2
4,580,784 A * 4/1986 Brill ..... A63B 47/02 473/286
4,754,977 A 7/1988 Sahm
4,846,515 A * 7/1989 Hall, Sr. ..... A63B 47/02 294/99.1
4,869,507 A 9/1989 Sahm
4,927,144 A 5/1990 Stormon
4,934,702 A * 6/1990 Serizawa ..... A63B 53/0487 473/286
4,976,436 A * 12/1990 Serizawa ..... A63B 53/0487 473/286
4,979,742 A * 12/1990 DiFranco ..... A63B 47/001 473/517
5,102,139 A * 4/1992 Greig ..... A63B 47/02 473/285
5,116,047 A 5/1992 Phelan et al.
5,127,653 A 7/1992 Nelson
5,137,275 A 8/1992 Nelson
5,193,806 A 3/1993 Burkly
D335,317 S 5/1993 Shearer
D335,692 S 5/1993 Antonious
D336,757 S 6/1993 Antonious
5,228,332 A 7/1993 Bernhardt
5,244,205 A 9/1993 Melanson et al.
5,269,525 A * 12/1993 Hull ..... A63B 47/02 473/286
5,275,412 A 1/1994 Innes
D350,582 S 9/1994 Miansian et al.
5,368,302 A * 11/1994 Thomas ..... A63B 53/0487 473/286
5,388,827 A 2/1995 Reynolds, Jr.
5,390,918 A 2/1995 Meyers et al.
5,407,194 A * 4/1995 Snow ..... A63B 47/02 473/131
5,417,426 A * 5/1995 Bayer ..... A63B 57/207 473/285
5,429,366 A 7/1995 McCabe
D363,101 S 10/1995 Sturm
5,454,563 A 10/1995 Nagamoto et al.
5,470,063 A 11/1995 Fisher
D365,864 S 1/1996 Sturm
5,485,999 A * 1/1996 Hull ..... A63B 47/02 473/286
5,489,097 A 2/1996 Simmons
D368,751 S 4/1996 Rife
D369,393 S 4/1996 Takahashi et al.
5,509,658 A * 4/1996 Youngblood ..... A63B 53/0487 473/286
5,518,235 A 5/1996 Mendenhall
5,524,889 A * 6/1996 Rush ..... A63B 47/02 473/286
5,569,098 A 10/1996 Klein
5,571,053 A 11/1996 Lane
D378,688 S 4/1997 Cameron
5,628,696 A * 5/1997 Frye ..... A63B 47/02 473/328
5,647,807 A 7/1997 Nagamoto
D385,609 S 10/1997 Cameron
5,683,307 A 11/1997 Rife
5,688,190 A 11/1997 Rowland et al.
D388,143 S 12/1997 Huan-Chiang
5,692,968 A * 12/1997 Shine ..... A63B 53/04 473/340
D389,207 S 1/1998 Cameron
5,711,719 A 1/1998 Fireman
5,720,671 A 2/1998 Cheng
5,749,793 A 5/1998 Lucetti
5,775,751 A * 7/1998 Nelson ..... A63B 47/02 206/315.9
D398,685 S 9/1998 Masuda
5,803,824 A 9/1998 Rollingson
D399,290 S 10/1998 Sizemore, Jr.
D399,911 S 10/1998 Nicolette et al.
5,839,974 A 11/1998 McAllister
5,842,935 A 12/1998 Nelson
D405,836 S 2/1999 Nicolette et al.
5,890,969 A 4/1999 Bechler
D409,701 S 5/1999 Ashcraft et al.
5,924,938 A 7/1999 Hines
5,941,781 A 8/1999 Sessions
6,007,434 A 12/1999 Baker et al.

(56) References Cited

U.S. PATENT DOCUMENTS 6,039,656 A 3/2000 Fireman
D422,655 S 4/2000 Hicks
6,050,903 A 4/2000 Lake
6,059,334 A * 5/2000 LaCourse ..... A63B 57/00 294/19.2
D426,276 S 6/2000 Besnard et al.
6,083,113 A 7/2000 Bernhardt
D431,854 S 10/2000 Cameron
D432,192 S 10/2000 Hicks
D436,151 S 1/2001 Nicolette et al.
D437,374 S 2/2001 Cameron
6,217,460 B1 4/2001 Broadbridge et al.
D441,820 S 5/2001 Nicolette et al.
6,234,915 B1 5/2001 Wu
D443,668 S 6/2001 Nicolette et al.
D443,905 S 6/2001 Nicolette et al.
D444,833 S 7/2001 Wells et al.
6,264,571 B1 7/2001 Lekavich
6,277,033 B1 8/2001 Krumme et al.
D449,664 S 10/2001 Beebe et al.
D449,865 S 10/2001 Fife, Jr. et al.
D450,799 S 11/2001 Nicolette et al.
D451,973 S 12/2001 Wells et al.
6,348,014 B1 2/2002 Chiu
6,354,959 B1 3/2002 Nicolette et al.
6,394,910 B1 5/2002 McCarthy
6,478,694 B2 11/2002 Anderson et al.
D472,949 S 4/2003 Serrano
D474,821 S 5/2003 Wells et al.
D474,949 S 5/2003 Schaffeld et al.
6,561,919 B2 5/2003 Edel
D483,086 S 12/2003 Schweigert et al.
6,659,883 B2 12/2003 Nelson et al.
D486,872 S 2/2004 Schweigert et al.
D488,200 S 4/2004 Olsavsky et al.
D498,276 S 11/2004 Schweigert et al.
6,878,072 B1 * 4/2005 Henry ..... A63B 47/02 473/282
6,902,496 B2 6/2005 Solheim et al.
6,902,498 B2 6/2005 Sullivan et al.
D512,116 S 11/2005 Miraflor et al.
D513,777 S 1/2006 Cuellar
6,988,956 B2 1/2006 Cover et al.
6,997,819 B2 2/2006 Naylor et al.
D520,088 S 5/2006 Parr
7,059,971 B1 * 6/2006 Schmitt ..... A63B 60/50 473/285
7,077,760 B2 7/2006 Gray
D531,242 S 10/2006 Adams
D532,067 S 11/2006 Soracco et al.
7,153,220 B2 12/2006 Lo
D534,595 S 1/2007 Hasebe
7,156,752 B1 1/2007 Bennett
7,163,465 B2 1/2007 Edel
D536,400 S * 2/2007 DiBattista, Sr. ..... D21/736
D536,401 S 2/2007 Kawami
D536,403 S 2/2007 Kawami
D538,371 S 3/2007 Kawami
7,201,668 B1 4/2007 Pamias
7,204,765 B2 4/2007 Cover et al.
D542,869 S 5/2007 Adams
D543,598 S 5/2007 Kuan et al.
D543,601 S 5/2007 Kawami
7,223,178 B2 * 5/2007 Henry ..... A63B 47/02 473/282
7,278,926 B2 10/2007 Frame
D555,219 S 11/2007 Lin
D556,277 S 11/2007 Broom
7,309,297 B1 12/2007 Solari
D561,854 S 2/2008 Morris
7,331,876 B2 2/2008 Klein
7,351,162 B2 4/2008 Soracco et al.
D569,461 S 5/2008 Morris
D569,930 S 5/2008 Nehrbas
7,396,289 B2 7/2008 Soracco et al.
7,407,445 B2 8/2008 Pedraza et al.
7,416,494 B2 8/2008 Edel
D577,085 S 9/2008 Nicolette et al.
D577,086 S 9/2008 Nicolette et al.
D579,506 S 10/2008 Nicolette et al.
D579,995 S 11/2008 Nicolette et al.
D582,497 S 12/2008 Rollinson
7,473,189 B2 1/2009 Schweigert et al.
7,491,131 B2 2/2009 Vinton
D595,793 S 7/2009 Rollinson
7,559,848 B2 * 7/2009 Nickel ..... A63B 47/02 473/286
D599,425 S 9/2009 Laub
D600,763 S 9/2009 Cameron
7,722,476 B2 5/2010 Pedraza et al.
7,744,485 B2 6/2010 Jones et al.
D620,993 S 8/2010 Laub
D621,461 S 8/2010 Serrano et al.
D623,709 S 9/2010 Serrano et al.
7,846,036 B2 * 12/2010 Tanaka ..... A63B 53/0487 473/286
7,857,710 B2 12/2010 Pedraza
D631,925 S 2/2011 Broom
7,887,432 B2 2/2011 Jones et al.
7,909,707 B2 3/2011 Klein
7,918,745 B2 4/2011 Morris et al.
7,922,596 B2 * 4/2011 Vanderbilt ..... A63B 57/353 473/340
D638,891 S 5/2011 Nicolette et al.
D642,643 S 8/2011 Nicolette et al.
D643,485 S 8/2011 Nicolette et al.
D645,104 S 9/2011 Nicolette et al.
8,016,693 B2 9/2011 Pedraza
8,096,039 B2 1/2012 Soracco et al.
D653,718 S 2/2012 Stokke et al.
8,109,841 B2 2/2012 Miyamichi
D661,753 S 6/2012 Cameron et al.
D666,260 S 8/2012 Cynn
8,272,976 B2 * 9/2012 DAgostino ..... A63B 53/0466 294/19.2
8,371,958 B2 2/2013 Treadwell
8,376,878 B2 2/2013 Bennett et al.
D688,339 S 8/2013 Hilton et al.
D688,341 S 8/2013 Rollinson
D691,226 S 10/2013 Hilton et al.
8,632,415 B1 * 1/2014 Smith ..... A63B 47/04 473/340
8,636,607 B2 1/2014 Renna
D699,308 S 2/2014 Rollinson
8,696,492 B1 4/2014 Hocknell et al.
D704,782 S 5/2014 Rollinson
8,721,472 B2 5/2014 Kuan et al.
8,790,193 B2 7/2014 Serrano et al.
D711,483 S 8/2014 Wong
D715,388 S 10/2014 Serrano et al.
8,870,674 B1 10/2014 Abbott
D722,350 S 2/2015 Schweigert
D722,351 S 2/2015 Parsons et al.
D722,352 S 2/2015 Nicolette et al.
D723,120 S 2/2015 Nicolette
D724,164 S 3/2015 Schweigert et al.
D725,208 S 3/2015 Schweigert
D726,265 S 4/2015 Nicolette
D726,846 S 4/2015 Schweigert
D730,462 S 5/2015 Becktor et al.
D732,122 S 6/2015 Becktor
D732,618 S 6/2015 Becktor et al.
D733,234 S 6/2015 Nicolette
9,079,077 B2 7/2015 Wolf
9,108,088 B2 8/2015 Serrano et al.
9,108,092 B1 8/2015 Warner
D738,447 S 9/2015 Schweigert
D738,449 S 9/2015 Schweigert
D739,487 S 9/2015 Schweigert
D741,426 S 10/2015 Schweigert
D748,213 S 1/2016 Parsons et al.
D748,215 S 1/2016 Parsons et al.
9,233,283 B2 1/2016 Schweigert
9,272,193 B1 3/2016 Yim

(56) References Cited

U.S. PATENT DOCUMENTS

| | | | | |
|---|---|---|---|---|
| D753,252 | S | 4/2016 | Schweigert | |
| 9,375,615 | B2 | 6/2016 | Park | |
| 9,387,375 | B2 | 7/2016 | Schweigert | |
| 9,440,124 | B2 | 9/2016 | Parsons et al. | |
| 9,545,544 | B2 | 1/2017 | Jones et al. | |
| 9,604,108 | B1 | 3/2017 | Dunnell et al. | |
| 9,649,540 | B2 | 5/2017 | Parsons et al. | |
| 9,675,854 | B2 | 6/2017 | Wang et al. | |
| D801,457 | S | 10/2017 | Lewis | |
| 9,795,844 | B1 | 10/2017 | Dacey et al. | |
| 9,808,680 | B1 | 11/2017 | Myers et al. | |
| 9,895,585 | B2 | 2/2018 | Kroloff | |
| 9,925,427 | B2 | 3/2018 | Bischmann et al. | |
| 9,956,463 | B2 | 5/2018 | Franklin et al. | |
| 9,987,530 | B2 | 6/2018 | Jertson et al. | |
| 10,166,445 | B2 | 1/2019 | Brandt | |
| 10,478,680 | B2 | 11/2019 | Schweigert et al. | |
| 10,493,331 | B2 | 12/2019 | Kroloff et al. | |
| 10,576,339 | B2 | 3/2020 | Schweigert et al. | |
| 10,632,352 | B2 | 4/2020 | Lambeth et al. | |
| 10,668,340 | B2 | 6/2020 | Lambeth et al. | |
| 10,737,153 | B2 | 8/2020 | Schweigert et al. | |
| 10,821,341 | B2 | 11/2020 | Schweigert et al. | |
| 10,960,271 | B2 | 3/2021 | Kroloff et al. | |
| 10,981,038 | B2 | 4/2021 | Schweigert et al. | |
| 11,045,698 | B2 | 6/2021 | Schweigert et al. | |
| 11,090,535 | B1 | 8/2021 | Schweigert et al. | |
| 11,141,635 | B2 | 10/2021 | Schweigert et al. | |
| 11,161,021 | B2 | 11/2021 | Becktor et al. | |
| 11,298,597 | B2 | 4/2022 | Parsons et al. | |
| 11,364,422 | B1 | 6/2022 | Parsons et al. | |
| 11,369,849 | B2 | 6/2022 | Andrews et al. | |
| 11,420,100 | B2 | 8/2022 | Wang et al. | |
| 11,446,552 | B2 * | 9/2022 | Morris | A63B 47/02 |
| 11,517,798 | B2 | 12/2022 | Kroloff et al. | |
| 2002/0077193 | A1 | 6/2002 | Takeda | |
| 2002/0151376 | A1 | 10/2002 | Verne | |
| 2002/0193174 | A1 | 12/2002 | Edel | |
| 2003/0045372 | A1 | 3/2003 | Vrska et al. | |
| 2003/0199332 | A1 | 10/2003 | Lindsay | |
| 2004/0014532 | A1 | 1/2004 | Lee et al. | |
| 2004/0138003 | A1 | 7/2004 | Grace | |
| 2004/0147334 | A1 * | 7/2004 | D'Agguano | A63B 53/0487 473/286 |
| 2004/0180730 | A1 | 9/2004 | Franklin et al. | |
| 2005/0176520 | A1 * | 8/2005 | Henry | A63B 47/02 473/286 |
| 2006/0052178 | A1 | 3/2006 | Franklin et al. | |
| 2006/0091681 | A1 * | 5/2006 | Evilsizer | A63B 47/02 294/19.2 |
| 2006/0094522 | A1 | 5/2006 | Tang et al. | |
| 2006/0223649 | A1 | 10/2006 | Rife | |
| 2006/0240904 | A1 * | 10/2006 | Barbosa | A63B 47/02 473/286 |
| 2007/0129163 | A1 | 6/2007 | Solari | |
| 2007/0135232 | A1 | 6/2007 | Billings | |
| 2007/0142122 | A1 | 6/2007 | Bonneau | |
| 2007/0191131 | A1 * | 8/2007 | Nickel | A63B 57/207 473/285 |
| 2007/0207875 | A1 | 9/2007 | Kuan et al. | |
| 2007/0238548 | A1 | 10/2007 | Johnson | |
| 2008/0139333 | A1 | 6/2008 | Klein | |
| 2008/0146372 | A1 | 6/2008 | John | |
| 2008/0176672 | A1 | 7/2008 | Roach et al. | |
| 2009/0029800 | A1 | 1/2009 | Jones et al. | |
| 2009/0156328 | A1 | 6/2009 | Reese | |
| 2009/0163287 | A1 | 6/2009 | Vald Via et al. | |
| 2009/0170629 | A1 * | 7/2009 | Hilton | A63B 53/0487 473/340 |
| 2009/0239678 | A1 | 9/2009 | De La et al. | |
| 2009/0275420 | A1 * | 11/2009 | Tanaka | A63B 47/02 473/286 |
| 2010/0009781 | A1 * | 1/2010 | Vanderbilt | A63B 53/0487 73/104 |
| 2010/0035700 | A1 | 2/2010 | Yu et al. | |
| 2010/0255922 | A1 | 10/2010 | Lueders | |
| 2010/0317454 | A1 | 12/2010 | Sato et al. | |
| 2011/0165959 | A1 | 7/2011 | Klein | |
| 2012/0064988 | A1 * | 3/2012 | Raab | A63B 53/0487 473/340 |
| 2013/0005499 | A1 | 1/2013 | Cameron | |
| 2013/0165256 | A1 | 6/2013 | Stevenson | |
| 2013/0210537 | A1 | 8/2013 | Ainscough et al. | |
| 2014/0100053 | A1 | 4/2014 | Stokke et al. | |
| 2015/0306477 | A1 | 10/2015 | Parsons et al. | |
| 2016/0016050 | A1 | 1/2016 | Rife et al. | |
| 2016/0136487 | A1 | 5/2016 | Clarke et al. | |
| 2016/0346649 | A1 | 12/2016 | Jertson et al. | |
| 2017/0340926 | A1 * | 11/2017 | Morris | A63B 47/02 |
| 2018/0001163 | A1 | 1/2018 | Becktor et al. | |
| 2018/0021635 | A1 * | 1/2018 | Lewis | A63B 53/0487 473/286 |
| 2018/0311545 | A1 | 11/2018 | Lambeth et al. | |
| 2018/0361206 | A1 | 12/2018 | Becktor et al. | |
| 2021/0146205 | A1 | 5/2021 | Parsons et al. | |
| 2021/0245019 | A1 | 8/2021 | Schweigert et al. | |
| 2021/0299527 | A1 | 9/2021 | Schweigert et al. | |
| 2022/0152464 | A1 | 5/2022 | Pedraza | |
| 2023/0364479 | A1 | 11/2023 | Serrano et al. | |

FOREIGN PATENT DOCUMENTS

| | | | | |
|---|---|---|---|---|
| GB | 2441974 | A | | 3/2008 |
| JP | H09271542 | A | | 10/1997 |
| JP | H11253590 | A | | 9/1999 |
| JP | 2000271253 | A | | 10/2000 |
| JP | 3167112 | B2 | | 5/2001 |
| JP | 2004223184 | A | | 8/2004 |
| JP | 2005065796 | A | | 3/2005 |
| JP | 2005160691 | A | | 6/2005 |
| JP | 2007130203 | A | * | 5/2007 |
| JP | 2007307334 | A | * | 11/2007 |
| JP | 3146587 | U | | 11/2008 |
| JP | 2013043091 | A | | 3/2013 |
| JP | 2021164588 | A | * | 10/2021 |
| KR | 200377377 | Y1 | | 3/2005 |
| KR | 200403045 | Y1 | | 12/2005 |
| KR | 20070113833 | A | | 11/2007 |
| KR | 20100065481 | A | | 6/2010 |
| KR | 101773069 | B1 | | 8/2017 |
| KR | 101980597 | B1 | | 5/2019 |
| WO | 9747364 | A1 | | 12/1997 |
| WO | 03020372 | A2 | | 3/2003 |
| WO | 2006087846 | A1 | | 8/2006 |
| WO | 2006113966 | A1 | | 11/2006 |
| WO | 2008074093 | A1 | | 6/2008 |
| WO | 2011043708 | A1 | | 4/2011 |
| WO | 2012036991 | A1 | | 3/2012 |
| WO | 2014145547 | A2 | | 9/2014 |
| WO | 2015005593 | A1 | | 1/2015 |

* cited by examiner

GOLF CLUB HEADS AND METHODS TO MANUFACTURE GOLF CLUB HEADS

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

CROSS REFERENCE

This application is a continuation of U.S. application Ser. No. 18/621,629, filed Mar. 29, 2024, which claims the benefit of U.S. Provisional Application No. 63/619,405, filed Jan. 10, 2024, and claims the benefit of U.S. Provisional Application No. 63/612,481, filed Dec. 20, 2023.

U.S. application Ser. No. 18/621,629, filed Mar. 29, 2024 is a continuation-in-part of U.S. application Ser. No. 18/385,952, filed Nov. 1, 2023, now U.S. Pat. No. 12,011,644, which is a continuation of application Ser. No. 18/219,215, filed Jul. 7, 2023, now U.S. Pat. No. 11,839,801, which claims the benefit of U.S. Provisional Application No. 63/524,452, filed Jun. 30, 2023, and the benefit of U.S. Provisional Application No. 63/470,711, filed Jun. 2, 2023.

U.S. application Ser. No. 18/621,629, filed Mar. 29, 2024 is a continuation-in-part of application Ser. No. 18/102,534, filed Jan. 27, 2023, which claims the benefit of U.S. Provisional Application No. 63/402,587, filed Aug. 31, 2022, and claims the benefit of U.S. Provisional Application No. 63/390,206, filed Jul. 18, 2022.

The disclosures of the above-referenced applications are incorporated by reference herein in their entirety.

FIELD

The present disclosure generally relates to golf equipment, and more particularly, to golf club heads and methods to manufacture golf club heads.

BACKGROUND

Certain putters include a retention feature that enables an individual to pick up a golf ball using a putter a head. Oftentimes, it may be difficult to release the golf ball from retention. Accordingly, there is a need for a putter head equipped with a retention feature that not only sufficiently retains a golf ball, but also does not impede an individual from dislodging the golf ball. This need is addressed by the following disclosure.

Figure 1:
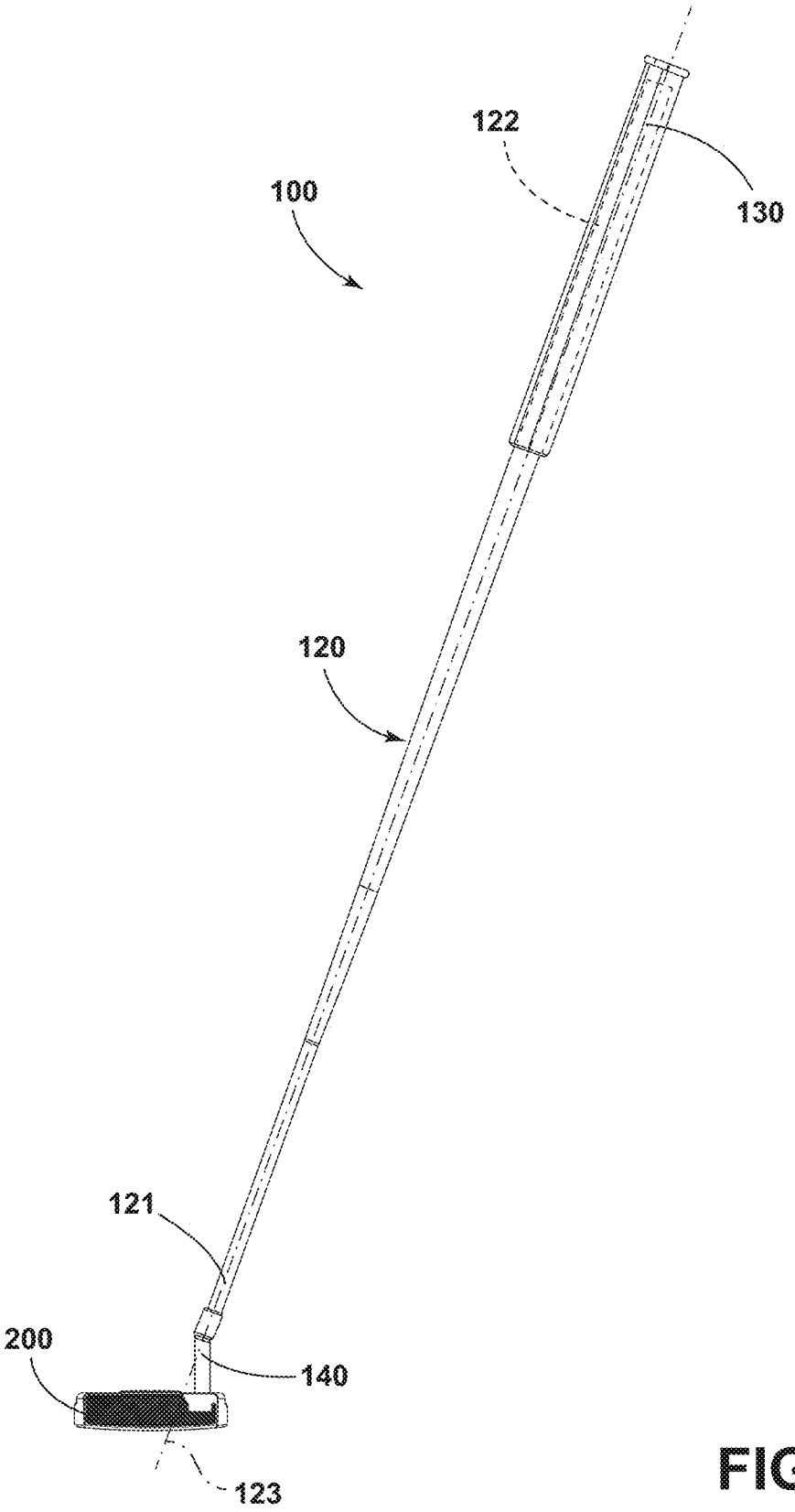
FIG. 1 depicts a front view of a golf club according to an embodiment of the apparatus, methods, and articles of manufacture described herein.
Figure 2:
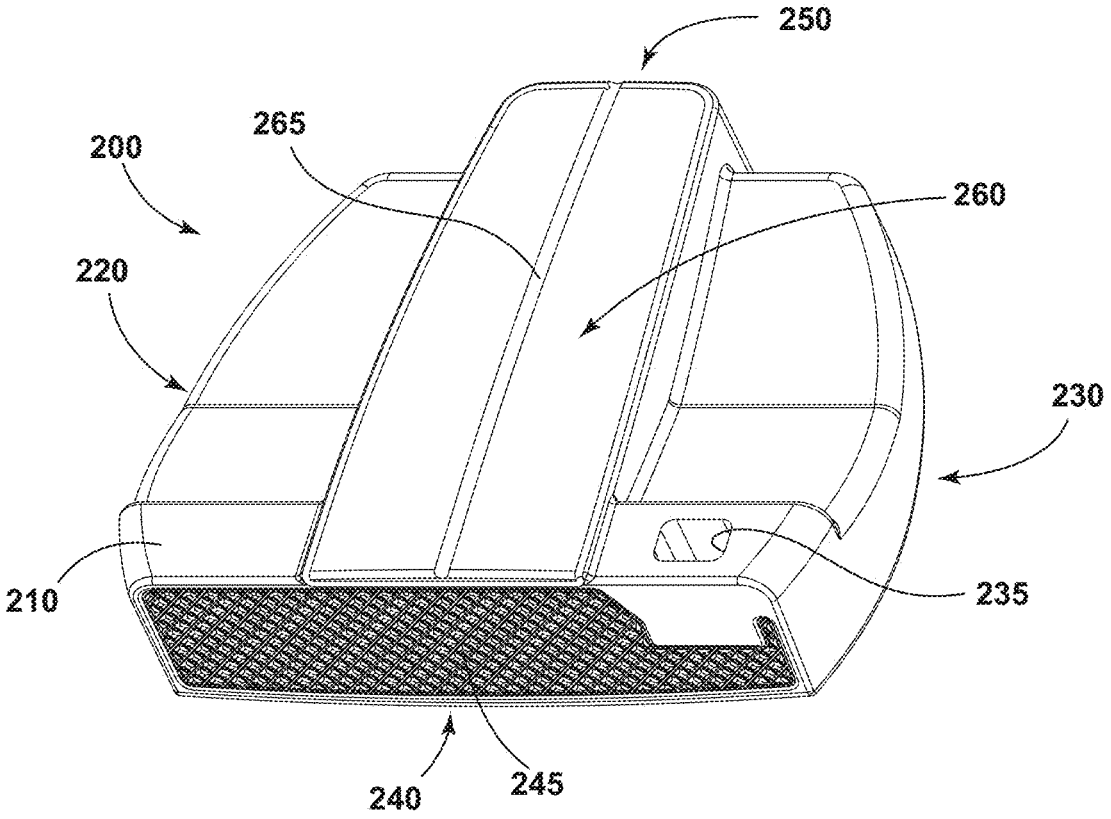
FIG. 2 depicts a front and top perspective view of a golf club head according to an embodiment of the apparatus, methods, and articles of manufacture described herein.
Figure 3:
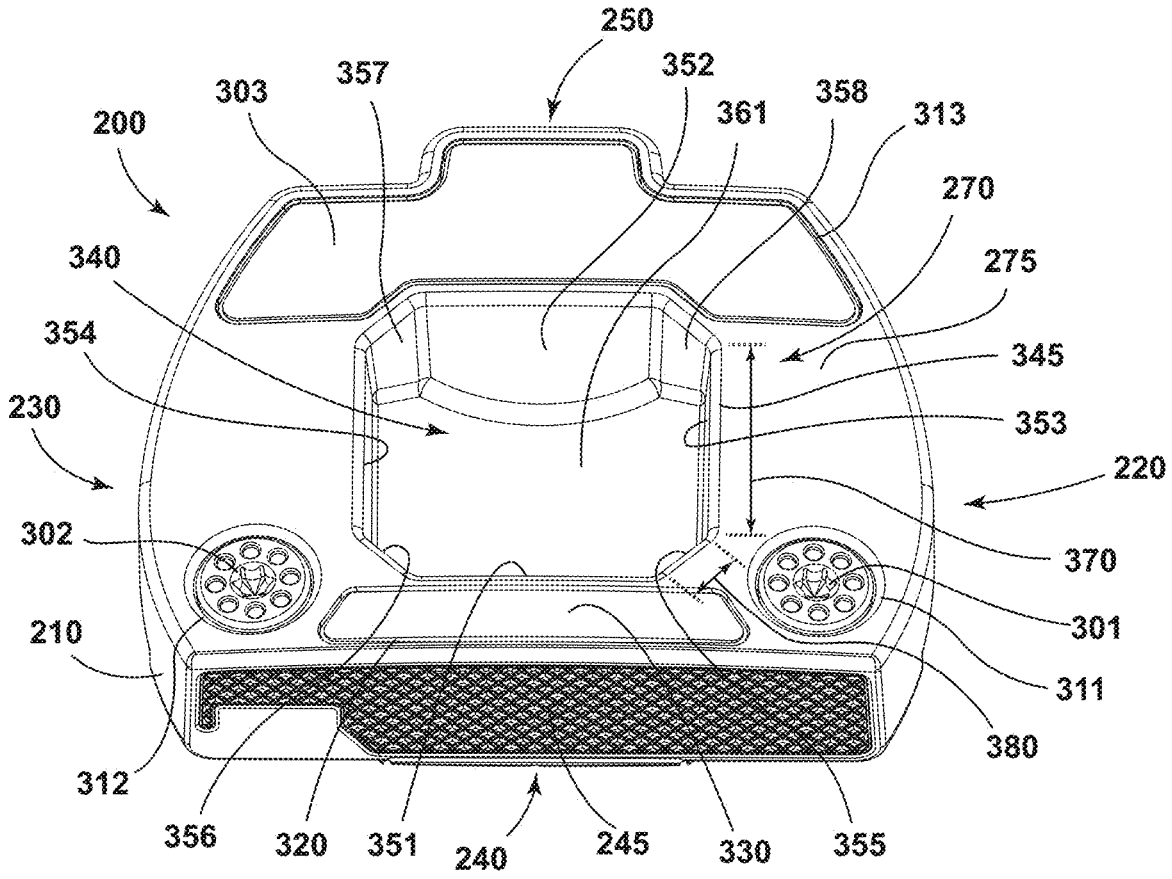
FIG. 3 depicts a front and bottom perspective view of the golf club head of FIG. 2.
Figure 4:
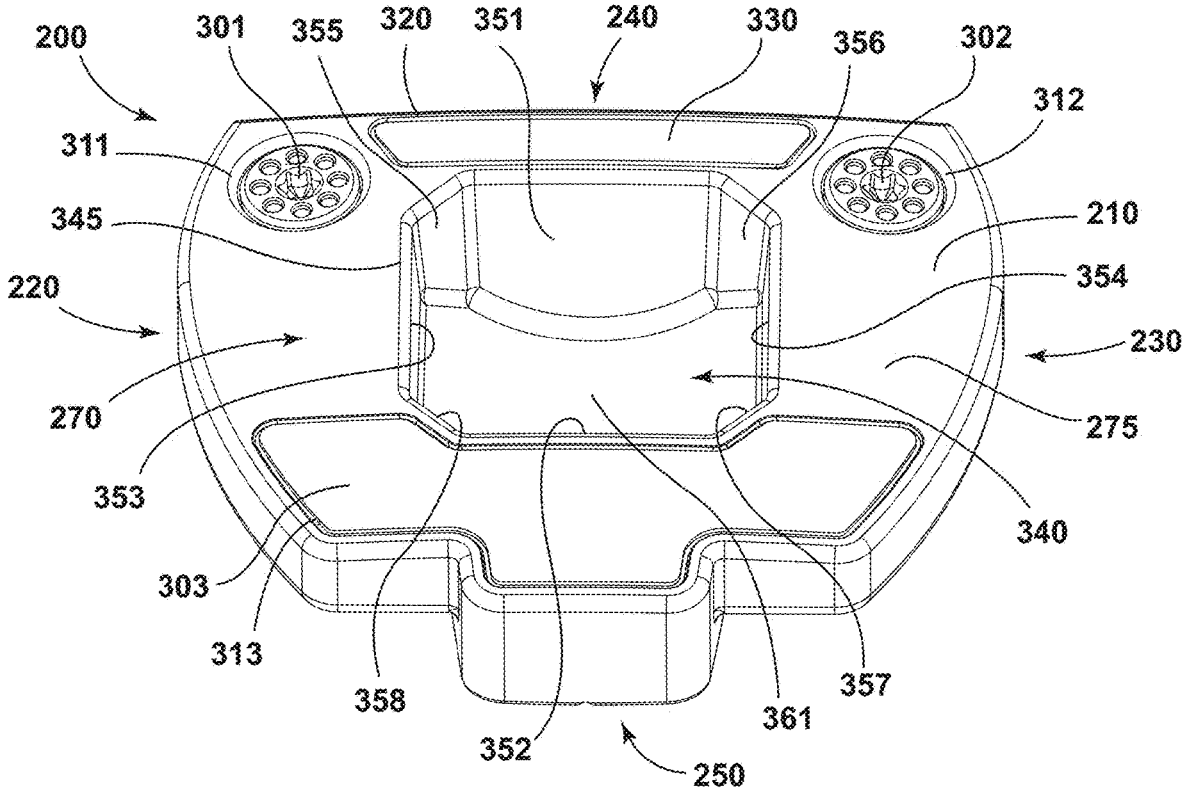
FIG. 4 depicts a rear and bottom perspective view of the golf club head of FIG. 2.
Figure 5:
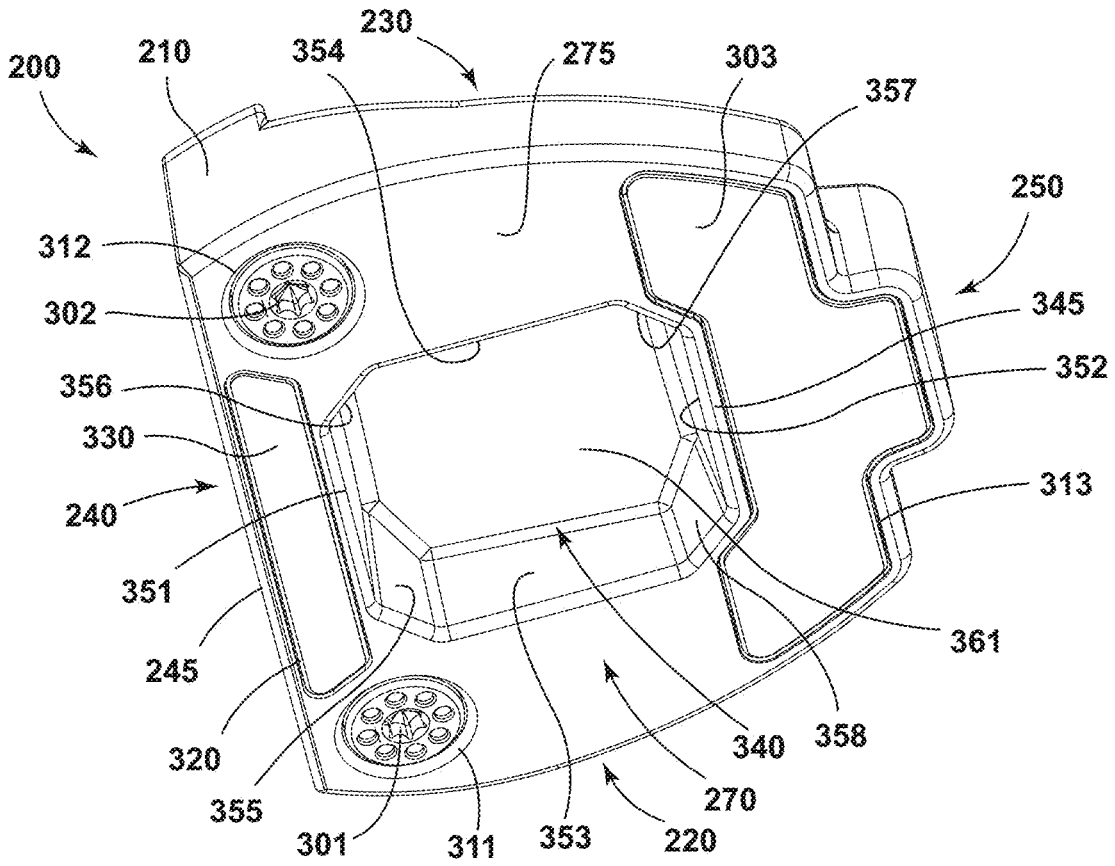
FIG. 5 depicts a heel-side and bottom perspective view of the golf club head of FIG. 2.
Figure 6:
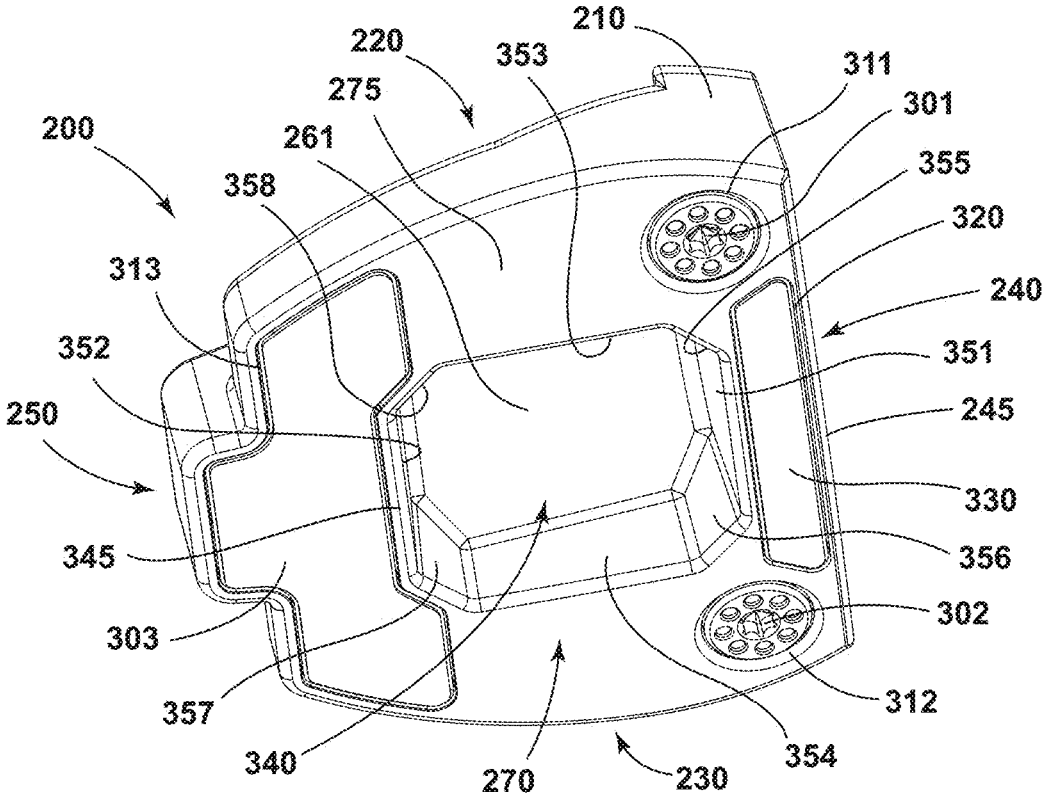
FIG. 6 depicts a toe-side and bottom perspective view of the golf club head of FIG. 2.
Figure 7:
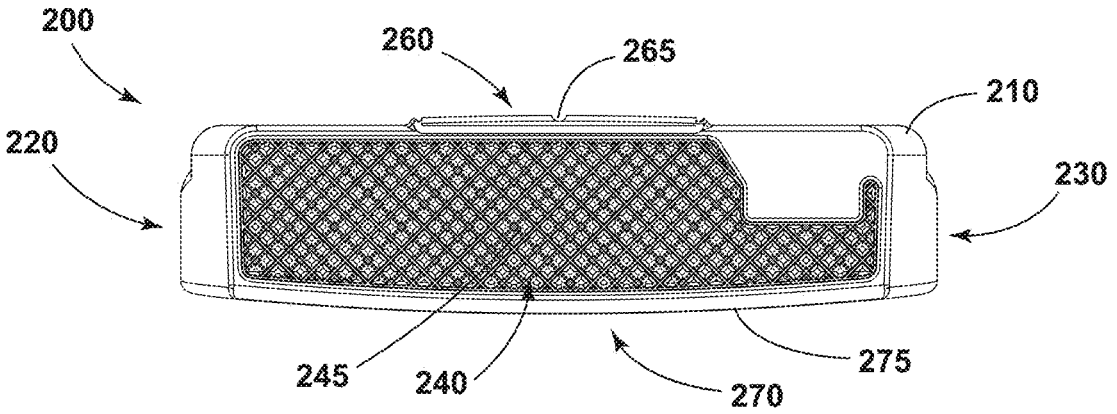
FIG. 7 depicts a front view of the golf club head of FIG. 2.
Figure 8:
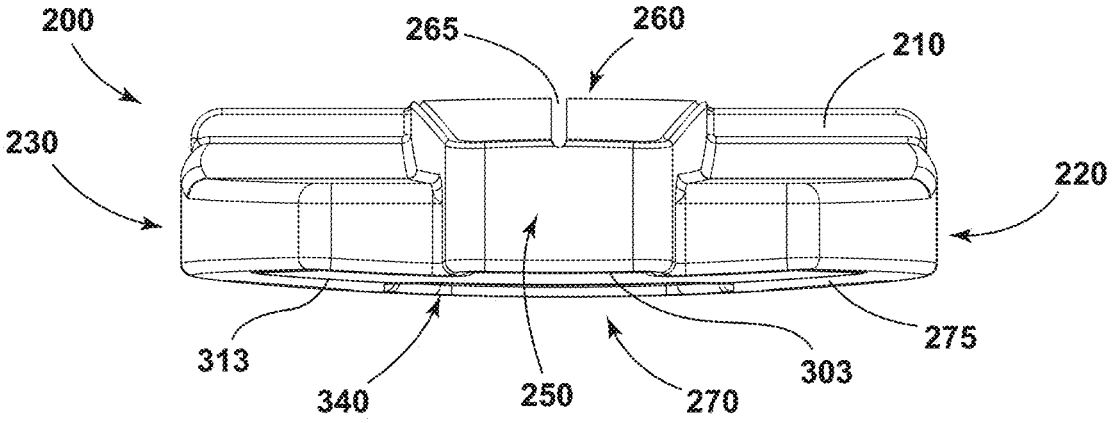
FIG. 8 depicts a rear view of the golf club head of FIG. 2.
Figure 9:
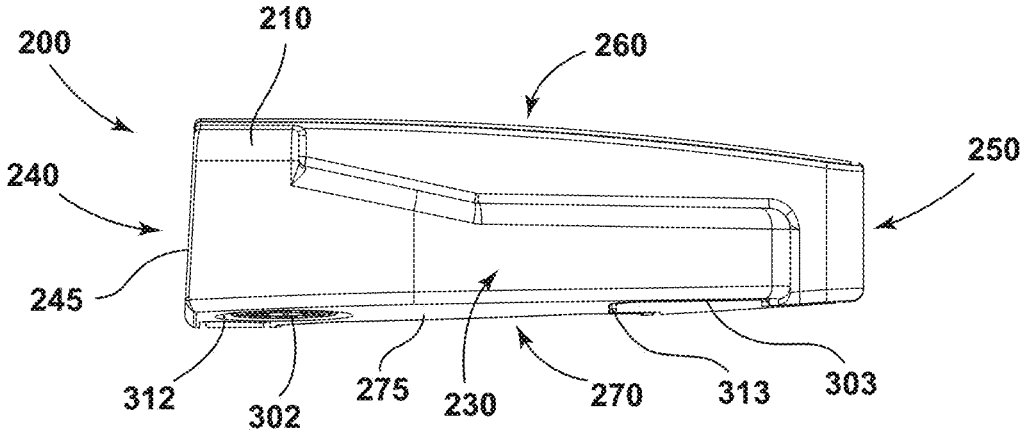
FIG. 9 depicts a heel-side view of the golf club head of FIG. 2.
Figure 10:
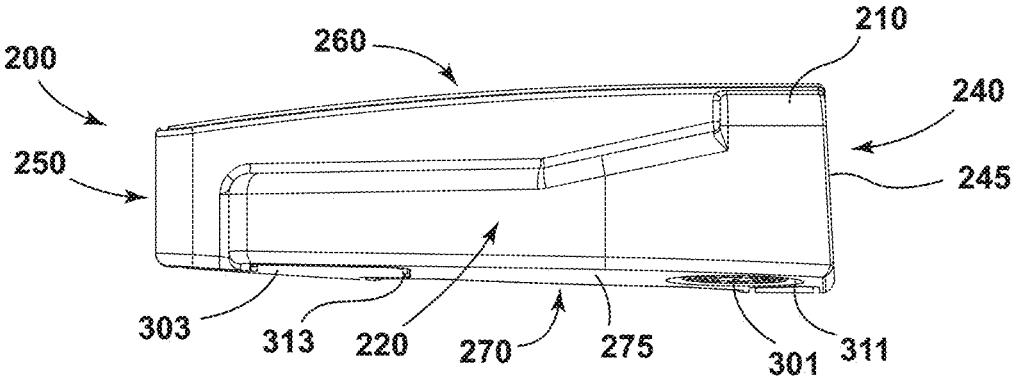
FIG. 10 depicts a toe-side view of the golf club head of FIG. 2.
Figure 11:
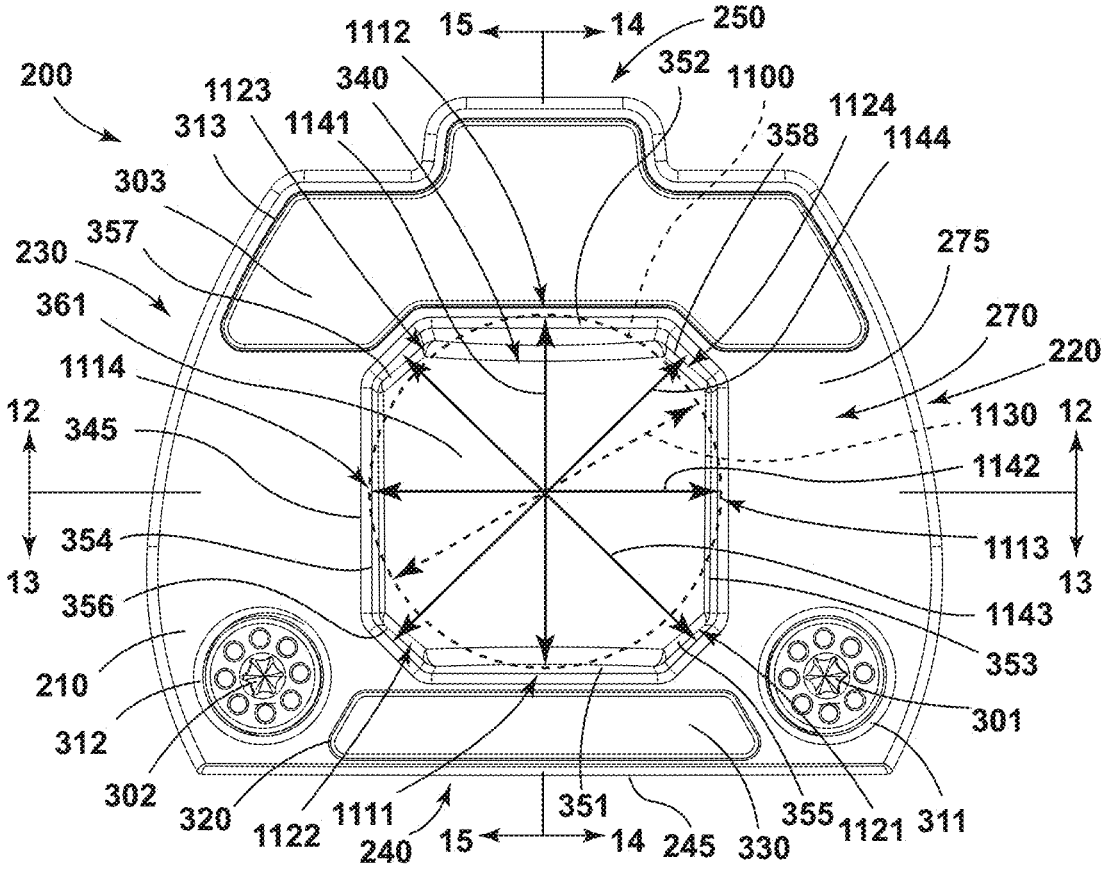
FIG. 11 depicts a bottom view of the golf club head of FIG. 2 in which a golf ball is retained within a retention cavity located at a sole portion of the golf club head.
Figure 12:
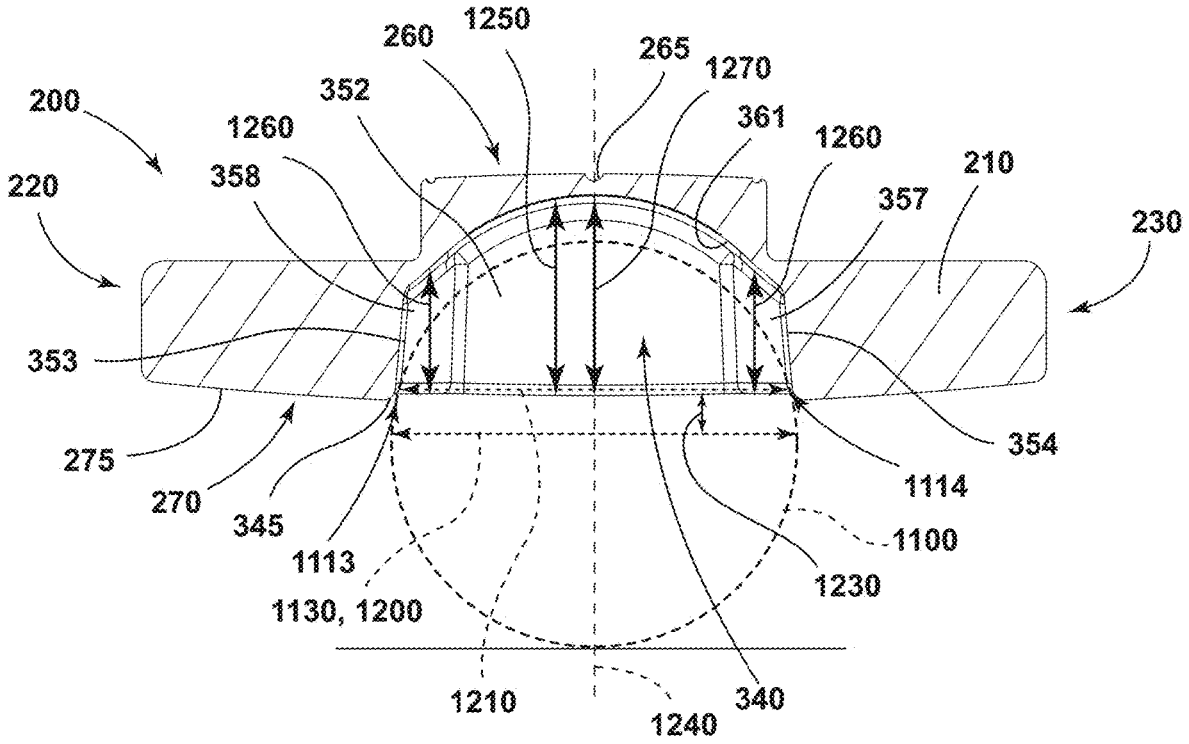
FIG. 12 depicts a cross-sectional view of the golf club head of FIG. 2 taken along line 12-12 of FIG. 11.
Figure 13:
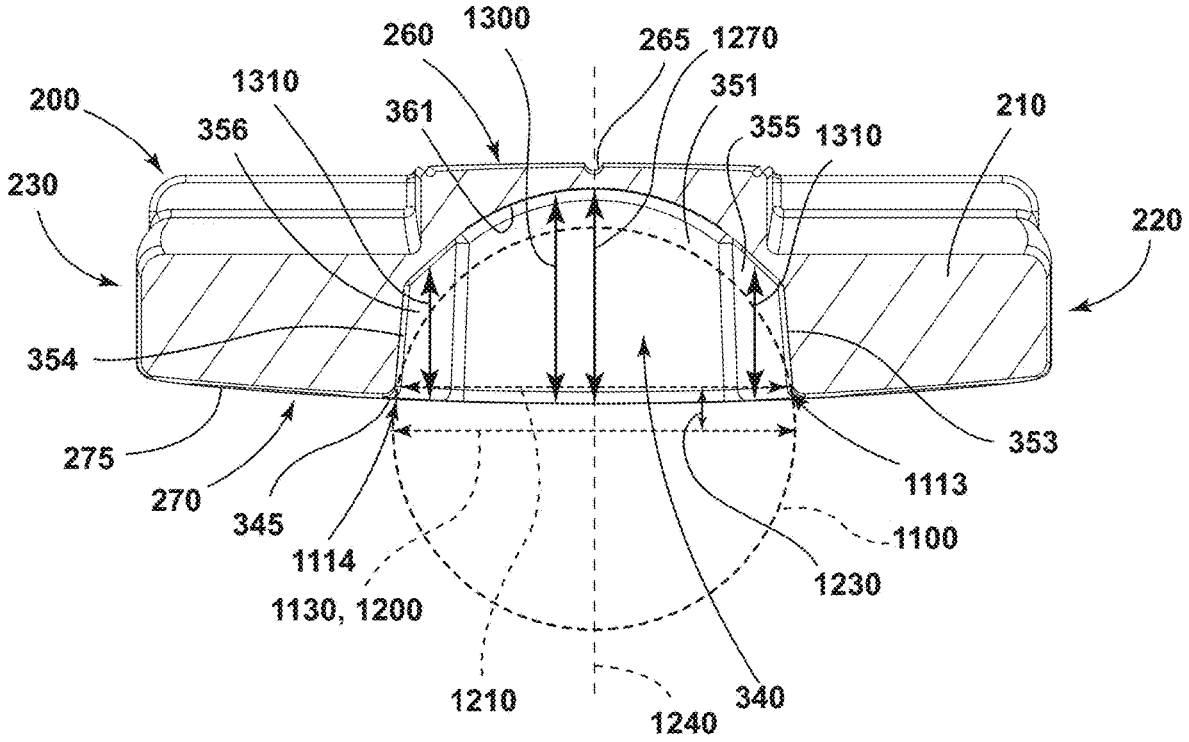
FIG. 13 depicts a cross-sectional view of the golf club head of FIG. 2 taken along line 13-13 of FIG. 11.
Figure 14:
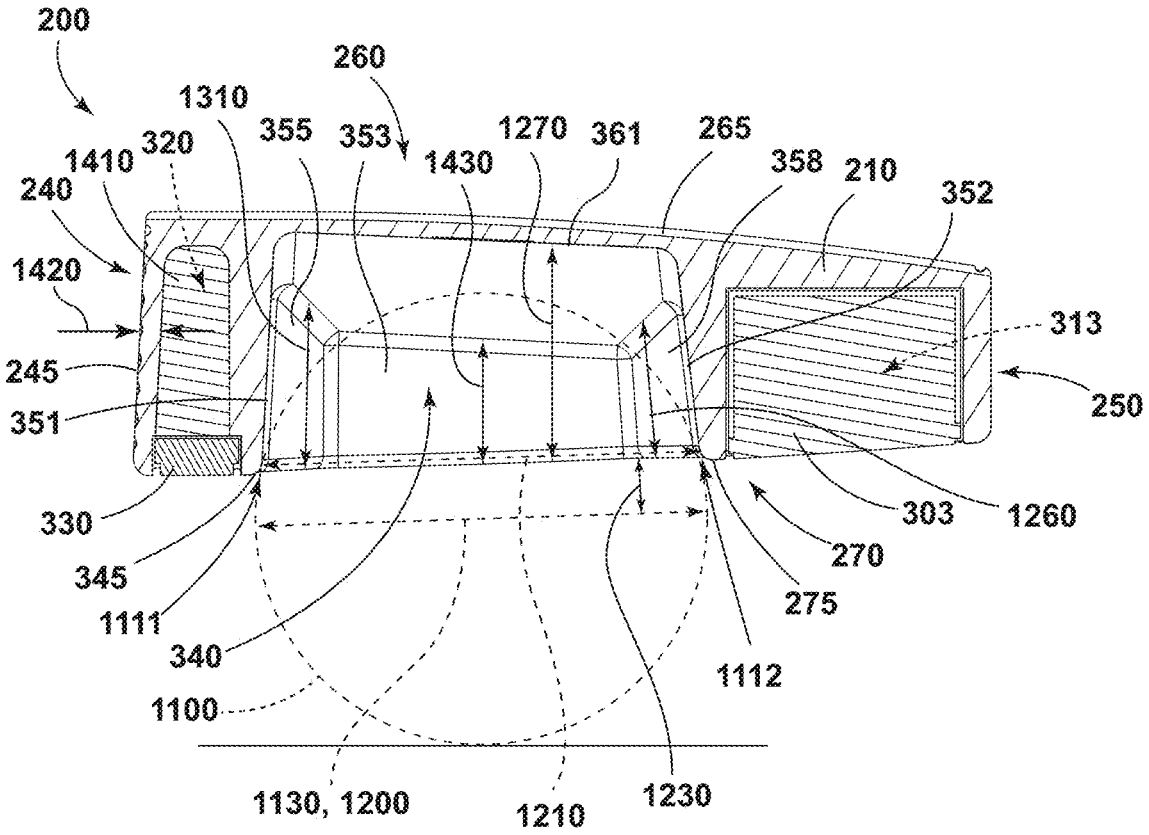
FIG. 14 depicts a cross-sectional view of the golf club head of FIG. 2 taken along line 14-14 of FIG. 11.
Figure 15:
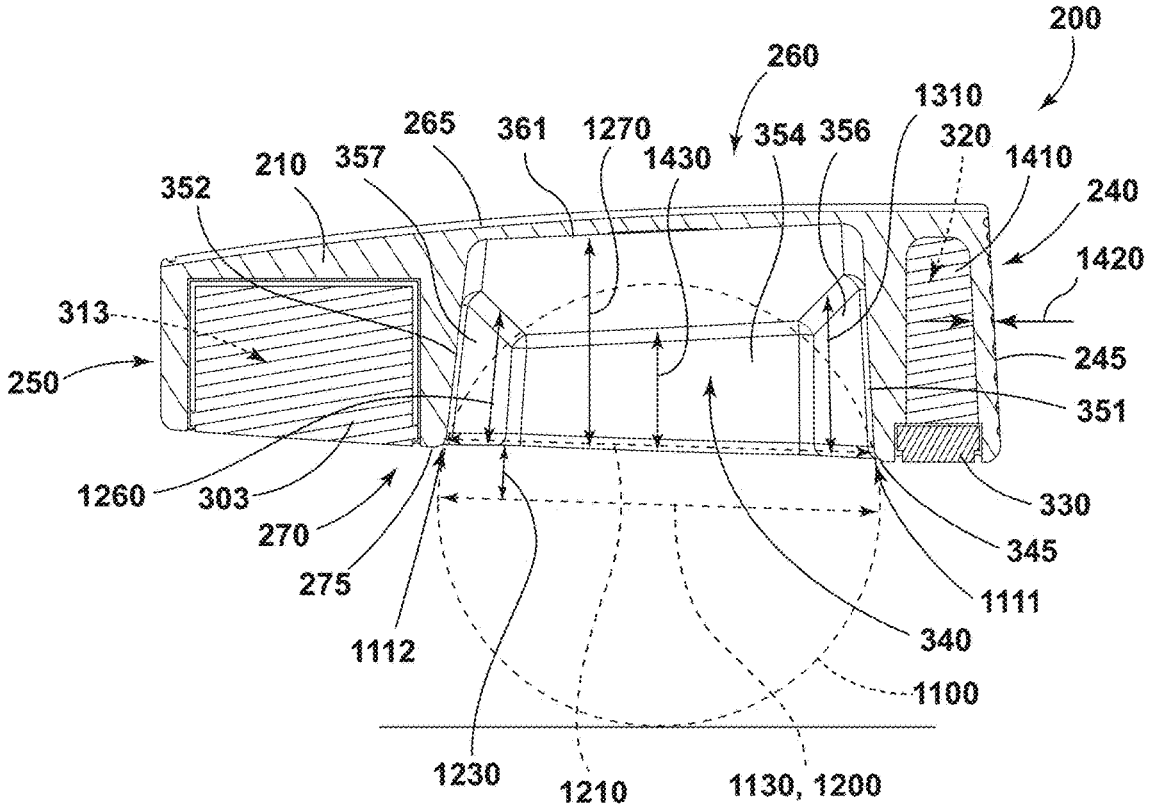
FIG. 15 depicts a cross-sectional view of the golf club head of FIG. 2 taken along line 15-15 of FIG. 11.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

The following U.S. patents and patent applications, which are collectively referred to herein as "the incorporated by reference patent documents," are incorporated by reference herein in their entirety: U.S. Pat. Nos. 9,233,283; 9,387,375; 9,440,124; 9,649,540; 9,895,585; 10,478,680; 10,493,331; 10,576,339; 10,737,153; 10,821,341; 10,960,271; 10,981,038; 11,045,698; 11,298,597; 11,369,849; and 11,517,798; 11,839,801; 11,918,869; and U.S. Patent Publication Nos. 20180200589; 20220219054; and 20230338795.

In general, golf club heads and methods to manufacture golf club heads are described herein. The apparatus, methods, and articles of manufacture described herein are not limited in this regard.

In the example of FIG. 1, a golf club 100 is generally shown as a putter-type golf club. The golf club 100 may include a shaft 120, a grip 130, a hosel portion 140, and a golf club head 200. The hosel portion 140 may be a separate part of the golf club 100 or be an integral part of the golf club head 200. The shaft 120 may have a first end portion 121 and a second end portion 122 and may define a shaft axis 123 that may or may not intersect with the golf club head 200. The second end portion 122 of the shaft 120 may be coupled to the grip 130 and the first end portion 121 of the shaft 120 may be coupled to the hosel portion 140. The hosel portion 140 may be coupled to the golf club head 200 via a hosel bore or may be integral with the golf club head 200 or otherwise coupled to the golf club head 200. The golf club head 200 may have a head mass greater than or equal to 300 grams and less than or equal to 400 grams. The shaft 120 may be formed from a metal material, a composite material, or any other suitable material or combination of materials.

The grip 130 may be formed from a rubber material, a polymer material, or any other suitable material or combination of materials. Additional examples of golf clubs and golf club components may be found in the incorporated by reference patent documents. The apparatus, methods, and articles of manufacture described herein are not limited in this regard.

In the example of FIGS. 2-15, the golf club head 200 may include a body portion 210 having a toc portion 220, a heel portion 230, a front portion 240, a rear portion 250, a top portion 260, and a sole portion 270. The body portion 210 may also include a hosel bore 235 located at or proximate the heel portion 230, a face portion 245 (e.g., a strike face) located at the front portion 240, and an alignment aid 265 located at the top portion 260, examples of which may be found in the incorporated by reference patent documents. The body portion 210 may be manufactured via various manufacturing methods and/or processes (e.g., a casting process, a forging process, a milling process, a cutting process, a grinding process, a welding process, a combination thereof, etc.). The body portion 210 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 210 may be partially or entirely made of a non-metal material (e.g., composite, plastic, etc.). In one example, the body portion 210 may be made of an aluminum-based material having a mass greater than or equal to 150 grams and less than or equal to 200 grams. The apparatus, methods, and articles of manufacture described herein are not limited in this regard.

The golf club head 200 may also include one or more weight portions (e.g., shown as weight portions 301, 302, and 303), each of which may be coupled to a corresponding weight port (e.g., shown as weight ports 311, 312, and 313) that may be variously located in the body portion 210. In one example, weight ports 311 and 312 and corresponding weight portion 301 and 302 may be located at the sole portion 270 at or proximate the front portion 240. Additionally, weight ports 311 and 312 may be disposed at or proximate the toc portion 220 and the heel portion 230, respectively. Weight portions 301 and 302 may be configured as screw weights configured to engage corresponding threads in the weight ports 311 and 312, respectively. In one example, weight portions 301 and 302 may be interchangeable. Weight port 313 and corresponding weight portion 303 may be located at or proximate the rear portion 250 and may extend between the toe portion 220 and the heel portion 230. Weight portion 303 may be configured as a complementary insert that is adhered or otherwise coupled to weight port 313. Weight portions 301, 302, and 303 may be configured to be flush or substantially flush with a bottom surface 275 of the sole portion 270. Weight portions 301, 302, and 303 may each be made of any of the materials described herein. In one example, weight portions 301, 302, and 303 may each be made of a material having a density that is greater than a material of the body portion 210 to redistribute mass at or proximate a periphery of the golf club head 200 in order to increase a moment of inertia (MOI) of the golf club head 200. Additionally, weight portion 303 may be significantly larger in size and mass than each of weight portions 301 and 302 to increase a center of gravity (CG) depth of the golf club head 200, or in other words, shift the CG of the golf club head 200 farther away from a shaft axis (e.g., see shaft axis 123) in a rearward direction of the golf club head 200 to improve the stability of the golf club head 200 during a golf swing. By locating the CG farther away from the shaft axis, a greater force may be required to twist or rotate the golf club head 200 from its natural path during a putting stroke. Accordingly, the golf club head 200 described herein may benefit from higher MOI and greater forgiveness. In one example, weight portion 303 may be at least ten times larger in size and/or mass than each of weight portions 301 and 302. In another example, weight portion 303 may be at least 11 times larger in size and/or mass than each of weight portions 301 and 302. In yet another example, weight portion 303 may be at least 12 times larger in size and/or mass than each of weight portions 301 and 302. In one example, weight portions 301 and 302 may each have a volume greater than or equal to 0.061 cubic inches (ci) (1.003 cubic centimeters (cc)) and less than or equal to 0.083 ci (1.360 cc). Weight portions 301 and 302 may each be made of a stainless steel-based material having a mass greater than or equal to 8 grams and less than 10 grams. Weight portion 303 may have a volume greater than or equal to 0.844 ci (13.831 cc) and less than or equal to 1.142 ci (18.714 cc) and may be made of a stainless steel-based material having a mass greater than or equal to 108 grams and less than or equal to 146 grams. In another example, weight portions 301, 302, and/or 303 may be made of a tungsten-based material of variable size and/or mass. Additional examples of weight portions and weight ports may be found in the incorporated by reference patent documents. The apparatus, methods, and articles of manufacture described herein are not limited in this regard.

The golf club head 200 may additionally include a filler material 1410 housed within a cavity 320 located at the sole portion 270 and disposed behind at least a portion of the face portion 245. The cavity 320 may extend toward the top portion 260 and may extend between the toe portion 220 and the heel portion 230. In one example, the filler material 1410 may be provided to the cavity 320 as an injectable polymer material that undergoes hardening via a curing process. In another example, the filler material 1410 may be provided to the cavity 320 as a polymer insert. The filler material 1410 may be configured to partially or entirely fill the cavity 320. In one example, the filler material 1410 may have a volume greater than or equal to 1.547 ci (25.351 cc) and less than or equal to 2.094 ci (34.315 cc) and may be made of a polymer material having a mass greater than or equal to 5.508 grams and less than or equal to 7.452 grams. The filler material 1410 may structurally support the face portion 245 and may dampen sound and/or vibration when the face portion 245 strikes a golf ball. In one example, the face portion 245 may have a uniform or variable face thickness 1420 greater than or equal to 0.035 inch (0.089 cm) and less than or equal to 0.055 inch (0.140 cm). In another example, the face portion 245 may have a uniform or variable face thickness 1420 less than 0.035 inch (0.089 cm) or greater than 0.055 inch (0.140 cm). A sole plate 330 or other cover may be coupled to the sole portion 270 to close the cavity 320. The sole plate 330 may be configured to be flush or substantially flush with the bottom surface 275 of the sole portion 270. The sole plate 330 may be coupled to the sole portion 270 via welding, adhesive, mechanical fasteners, or any other suitable means. The sole plate 330 may be made of a material having a density that is similar to or different from a material of the body portion 210. In one example, the sole plate 330 may be made of an aluminum-based material having a mass greater than or equal to 2.907 grams and less than or equal to 3.933 grams. Additional examples of golf club heads including a filler material may be found in the incorporated by reference patent documents. The apparatus, methods, and articles of manufacture described herein are not limited in this regard.

The golf club head 200 may further include a retention cavity 340 located at the sole portion 270 and configured to engage and retain at least a portion of a golf ball 1100, which is shown in broken lines for visualization purposes. Accordingly, an individual using the golf club head 200 described herein may not be required to bend over to pick up the golf ball 1100. The retention cavity 340 may be concealed by the body portion 210 such that the retention cavity 340 is not visible when the golf club head 200 is viewed from above the top portion 260. The retention cavity 340 may be located between the filler material 1410 and weight portion 303 and between weight portions 301 and 302. In one example, the retention cavity 340 may include an opening 345, one or more interior side walls (e.g., shown as interior walls 351, 352, 353, 354, 355, 356, 357, and 358) extending upwardly from the opening 345 toward the top portion 260, and one or more interior roof structures (e.g., shown interior roof structure 361) connected to the one or more interior side walls. While the retention cavity 340 is generally shown in a particular orientation at or proximate a central location of the sole portion 270, in other examples, the retention cavity 340 may be disposed elsewhere at the sole portion 270. In other words, the location of the retention cavity 340 may be shifted toward the toe portion 220, the heel portion 230, the front portion 240, the rear portion 250, or a combination thereof. Additionally, the orientation of the retention cavity 340 may differ, or said differently, the retention cavity 340 may be rotated in a clockwise or a counterclockwise direction with respect to the orientation of the retention cavity 340 generally shown in FIG. 11. The apparatus, methods, and articles of manufacture described herein are not limited in this regard.

In the illustrated example, the opening 345 may have a polygonal or non-polygonal shape. In one example, the opening 345 may have an octagonal shape defined by opposing interior side walls 351 and 352, opposing interior side walls 353 and 354, opposing interior side walls 355 and 357, and opposing interior side walls 356 and 358. Interior side wall 351 may be disposed at or proximate the front portion 240 and may extend between the toe portion 220 and the heel portion 230. Interior side wall 352 may be disposed at or proximate the rear portion 250 and may extend between the toc portion 220 and the heel portion 230. Interior side wall 353 may be disposed at or proximate the toe portion 220 and may extend between the front portion 240 and the rear portion 250. Interior side wall 354 may be disposed at or proximate the heel portion 230 and may extend between the front portion 240 and the rear portion 250. Interior side wall 355 may extend from a toc-ward end of interior side wall 351 to a frontward end of interior side wall 353. Interior side wall 356 may extend from a heel-ward end of interior side wall 351 to a frontward end of interior side wall 354. Interior side wall 357 may extend from a rearward end of interior side wall 354 to a heel-ward end of interior side wall 352. Interior side wall 358 may extend from a rearward end of interior side wall 353 to a toc-ward end of interior side wall 352. Interior roof structure 361 may connect to an upper extent of each of interior side walls 351, 352, 353, 354, 355, 356, 357, and 358, respectively. The apparatus, methods, and articles of manufacture described herein are not limited in this regard.

The retention cavity 340 may define a space extending into the body portion 210 and may include two or more ball retention areas configured to frictionally engage and retain at least a portion of the golf ball 1100 within the retention cavity 340. In one example, the retention cavity 340 may have four retention areas including a first ball retention area 1111 defined by interior side wall 351, a second ball retention area 1112 defined by interior side wall 352, a third ball retention area 1113 defined by interior side wall 353, and a fourth ball retention area 1114 defined by interior side wall 354. In this configuration, the golf ball 1100 may be retained and prevented from shifting in a longitudinal direction (i.e., a front-to-rear direction of the golf club head 200) and a lateral direction (i.e., a heel-to-toc direction of the golf club head 200). In one example, the first, second, third, and fourth ball retention areas 1111, 1112, 1113, and 1114 may include portions of interior side walls 351, 352, 353, and 354 located at or proximate the opening 345 of the retention cavity 340, respectively. In operation, the retention cavity 340 may be positioned directly over the golf ball 1100 and the golf club head 200 may be urged downward toward the golf ball 1100 to eventually engage and retain at least a portion of the golf ball 1100 within the retention cavity 340. In the illustrated example, the first, second, third, and fourth retention areas 1111, 1112, 1113, and 1114 may include portions of interior side walls 351, 352, 353, and 354 that are rounded at the opening 345 to help urge the golf ball 1100 into retention and increase a ball contact area of each of the first, second, third, and fourth ball retention areas 1111, 1112, 1113, and 1114. Additionally, interior side walls 355, 352, 353, and 358 may also be rounded at the opening 345. The adoption of rounded edges at the opening 345 may also reduce tear on the golf ball 1100 when compared to sharp edges that tend to cut or dig into the golf ball 1100. With respect to any of the examples provided herein, any one of interior side walls 351-358 may include grip features for enhancing frictional engagement between the golf ball 1100 and the corresponding ball retention area. Such grip features may include grooves, textured surfaces, protrusions, and the like. The apparatus, methods, and articles of manufacture described herein are not limited in this regard.

To assist a user in dislodging the golf ball 1100 from the retention cavity 340, the retention cavity 340 may include a ball release feature characterized by one or more relief gaps formed between the golf ball 1100 retained within the retention cavity 340 and one or more of the interior side walls 351, 352, 353, 354, 355, 356, 357, and 358. In the illustrated example, the retention cavity 340 may include a first relief gap 1121 formed between the golf ball 1100 and interior side wall 355, a second relief gap 1122 formed between the golf ball 1100 and interior side wall 356, a third relief gap 1123 formed between the golf ball 1100 and interior side wall 357, and a fourth relief gap 1124 formed between the golf ball 1100 and interior side wall 358. With respect to any of the examples provided herein, the ball release feature may be variously configured to provide sufficient clearance to allow an individual to easily dislodge the golf ball 1100 from the retention cavity 340 using his or her finger(s) or some other object (e.g., a tee, divot repair tool, and the like). In the illustrated example, the retention cavity 340 may alternate between interior side walls (e.g., interior side walls 351, 352, 353, and 354) that contact the golf ball 1100 and interior side walls (e.g., interior side walls 355, 356, 357, and 358) that do not contact the golf ball 1100. In other examples, two or more interior side walls that contact a golf ball may be disposed adjacent to each other. Likewise, two or more interior side walls that do not contact a golf ball may be disposed adjacent to each other. The apparatus, methods, and articles of manufacture described herein are not limited in this regard.

In the illustrated example, the golf ball 1100 may have a diameter 1130 of 1.680 inches (4.268 cm) to comply with United States Golf Association (USGA) standards. In one example, the retention cavity 340 may have a volume greater than or equal to 1.547 ci (25.351 cc) and less than or equal to 2.094 ci (about 34.315 cc). Opposing interior side walls 351 and 352 and opposing interior side walls 353 and 354 may be separated by a distance (e.g., shown in FIG. 11 as 1141 and 1142, respectively), measured at or proximate the opening 345, that is less than or equal to the diameter 1130 of the golf ball 1100 to enable the corresponding first, second, third, and fourth ball retention areas 1111, 1112, 1113, and 1114 to frictionally engage the golf ball 1100 at or proximate an equator 1200 of the golf ball 1100. In one example, the distance 1141 between opposing interior side walls 351 and 352 and the distance 1142 between opposing interior side walls 353 and 354 may be greater than or equal to 1.620 inches (4.115 centimeters) and less than or equal to 1.670 inches (4.242 centimeters) such that the first, second, third, and fourth ball retention areas 1111, 1112, 1113, and 1114 frictionally engage the golf ball 1100 along a ball circumference 1210 located above the equator 1200 at a height 1230 greater than or equal to 0.050 inch (0.127 centimeters) and less than or equal to 0.070 inch (0.178 centimeters). Accordingly, the retention cavity 340 may be configured to retain less than 50% of a total volume of the golf ball 1100. In other examples, the retention cavity 340 may be configured to retain greater than or equal to 50% of the total volume of the golf ball 1100. By fashioning the retention cavity 340 to engage the golf ball 1100 slightly above the equator 1200, a greater degree of ball retention may be achieved due to an individual being able to exert greater downward force onto the golf ball 1100, which may cause the golf ball 1100 to become increasingly pinched between the first, second, third, and fourth ball retention areas 1111, 1112, 1113, and 1114. Additionally, in one example, opposing interior side walls 355 and 357 and opposing interior side walls 356 and 358 may be separated by a distance (e.g., shown in FIG. 11 as 1143 and 1144, respectively), measured at or proximate the opening 345, that is greater than the diameter 1130 of the golf ball 1100 to provide sufficient clearance via the corresponding first, second, third, and fourth relief gaps 1121, 1122, 1123, and 1124 to enable an individual to easily dislodge the golf ball 1100 using his or her finger(s) or some other object as described herein. In one example, the distance 1143 between opposing side walls 355 and 357 and/or the distance 1144 between opposing side walls 356 and 358 may be greater than or equal to 1.800 inches (4.572 centimeters) and less than or equal to 2.000 inches (5.080 centimeters). The apparatus, methods, and articles of manufacture described herein are not limited in this regard.

Interior side walls 351, 352, 353, 354, 355, 356, 357, and 358 may be configured with a variety of physical properties (e.g., size, shape, dimension, etc.) to accommodate the golf ball 1100 or other golf balls of different diameters. Interior side walls 351-358 may be similar or different from each other. Interior side walls 351, 352, 353, 354, 355, 356, 357, and 358 may be planar, curved, inward bulging, outward bulging, or follow any other suitable contour. In the illustrated example, interior side walls 351 and 352 may each have an arch shape or arch-like shape and interior side walls 353, 354, 355, 356, 357, and 358 may each have a trapezoidal shape or trapezoidal-like shape. Interior side walls 351-354 may have similar lengths (e.g., shown in FIG. 3 as length 370) and interior side walls 355, 356, 357, and 358 may have similar lengths (e.g., shown in FIG. 3 as length 380). In one example, the length 370 of interior side walls 351, 352, 353, and 354 may be about 1.141 inches (2.898 centimeters) and the length 380 of interior side walls 355, 356, 357, and 358 may be about 0.345 inches (0.876 centimeters). Any two adjacent interior side walls may form an interior angle of 135 degrees or about 135 degrees. Interior side walls 351 and 352 may each increase in height toward a center longitudinal plane 1240 of the golf club head 200 from both a heel-side direction and a toc-side direction of the golf club head 200. In one example, interior side wall 351 may have a variable height 1300 greater than or equal 0.600 inch (1.524 centimeters) and less than or equal to 0.950 inch (2.413 centimeters) and interior side wall 352 may have a height 1250 greater than or equal to 0.500 inch (1.270 centimeters) and less than or equal to 0.800 inch (2.032 centimeters). Interior side walls 353 and 354 may mirror each other about the center longitudinal plane 1240 of the golf club head 200 and may each decrease in height in a front-to-rear direction of the golf club head 200. In one example, interior side walls 353 and 354 may have each have a variable height 1430 greater than or equal to 0.300 inch (0.762 centimeters) and less than or equal to 0.500 inch (1.270 centimeters). Interior side walls 355 and 356 may mirror each other about the center longitudinal plane 1240 and may decrease in height in the front-to-rear direction of the golf club head 200. Additionally, interior side wall 355 may decrease in height in a heel-to-toe direction of the golf club head 200 whereas interior side wall 356 may increase in height in the heel-to-toc direction of the golf club head 200. In one example, interior side walls 355 and 356 may each have a variable height 1310 greater than or equal to 0.400 inch (1.016 centimeters) and less than or equal to 0.700 inch (1.778 centimeters). Interior side walls 357 and 358 may mirror each other about the center longitudinal plane 1240 and may increase in height in the front-to-rear direction of the golf club head 200. Additionally, interior side wall 357 may increase in height in the heel-to-toe direction of the golf club head 200 whereas interior side wall 358 may decrease in height in the heel-to-toe direction of the golf club head 200. In one example, interior side walls 357 and 358 may each have a height 1260 that is greater than or equal to 0.300 inch (0.762 centimeters) and less than or equal to 0.600 inch (1.524 centimeters). In the illustrated example, any two opposing interior side walls (e.g., opposing interior side walls 351 and 352, opposing interior side walls 353 and 354, opposing interior side walls 355 and 357, and opposing interior side walls 356 and 358) may be slanted such that the corresponding distance (e.g., distances 1141, 1142, 1143, and 1144) between the any two opposing interior side walls decreases in a sole-to-top direction of the golf club head 200. In other examples, any two opposing interior side walls may be configured such that a corresponding distance between the any two opposing interior side walls increases, decreases, and/or remains constant in the sole-to-top direction of the golf club head 200. The apparatus, methods, and articles of manufacture described herein are not limited in this regard.

The interior roof structure 361 may also be configured with a variety of physical properties (e.g., size, shape, dimension, etc.) to accommodate the golf ball 1100 or other golf balls of different diameters. Interior roof structure 361 may be planar, curved, inward bulging, outward bulging, or follow any other suitable contour. Interior roof structure 361 may contact or be spaced apart from the golf ball 1100 in retention. In the illustrated example, the interior roof structure 361 may have a dome shape or dome-like shape and may decrease in height in the front-to-rear direction of the golf club head 200 and may increase in height toward the center longitudinal plane 1240 of the golf club head 200 from both the heel-side direction and the toc-side direction of the golf club head 200. In one example, interior roof structure 361 may have a height 1270 along the center longitudinal plane 1240 that is greater than or equal to 0.800 inch (2.032 centimeters) and less than or equal to 0.950 inch (2.413 centimeters). The apparatus, methods, and articles of manufacture described herein are not limited in this regard.

Figure 16:
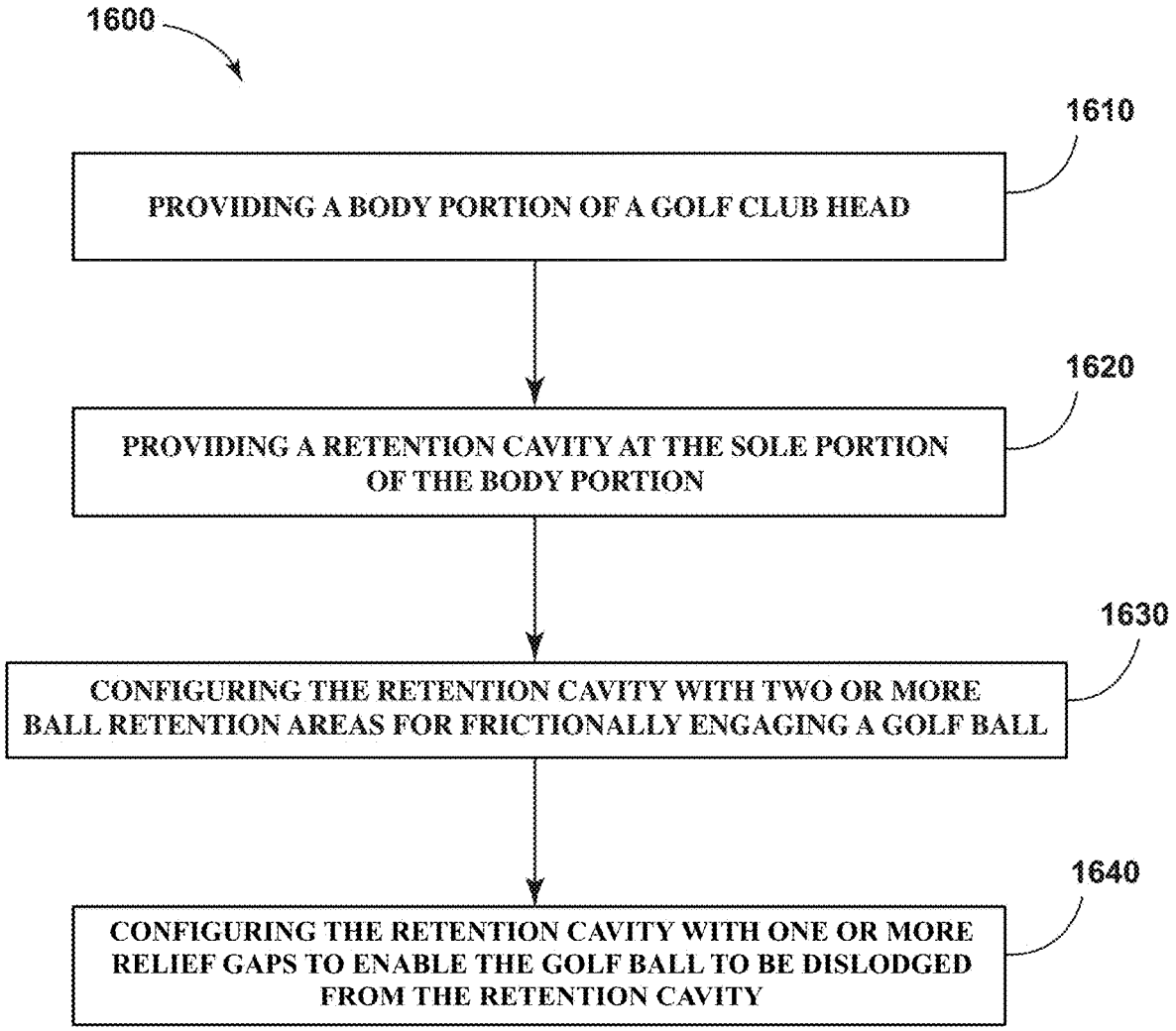
FIG. 16 depicts a process for manufacturing a golf club head according to an embodiment of the apparatus, methods, and articles of manufacture described herein.

FIG. 16 depicts a process 1600 by which the golf club head 200 described herein may be manufactured and is described below with continued reference to the example golf club head 200 of FIGS. 2-15. In the example of FIG. 16, the process 1600 may begin with providing a body portion 210 having a toc portion 220, a heel portion 230, a front portion 240, a rear portion 250, a top portion 260, and a sole portion 270 (block 1610). A retention cavity 340 may be provided at the sole portion 270, the retention cavity 340 including an opening 345, one or more interior side walls (e.g., interior side walls 351, 352, 353, 354, 355, 356, 357, and 358) extending upwardly from the opening 345, and one or more interior roof structures (e.g., interior roof structure 361) connected to the one or more interior side walls (block 1620). The retention cavity 340 may be configured with two or more ball retention areas (e.g., ball retention areas 1111, 1112, 1113, and 1114) for frictionally engaging and retaining at least a portion of a golf ball (e.g., golf ball 1100) within the retention cavity 340 (block 1630). The retention cavity 340 may also be configured with one or more relief gaps (e.g., relief gaps 1121, 1122, 1123, and 1124) to enable the golf ball 1100 to be dislodged from the retention cavity 340 (block 1640). The apparatus, methods, and articles of manufacture described herein are not limited in this regard.

While the above examples and figures may depict a retention cavity with a particular shape (e.g., one shown as the retention cavity 340 in FIG. 3), the apparatus, methods, and articles of manufacture described herein may include a retention cavity with a different bowl or cup shape (e.g., symmetrical or asymmetrical). Further, the opening of the retention cavity 340 (e.g., one shown as the opening 345 in FIG. 3) may have a shape different than the shape described and depicted in the above examples such as a circular shape, an elliptical shape, a triangular shape, a square shape, a rectangular shape, a pentagon shape, a hexagon shape, a heptagon shape, a nonagon shape, a decagon shape, or a shape including any other number of sides with one or more sides to frictionally engage a golf ball. Further, the interior roof structure of the retention cavity (e.g., one shown as the interior roof structure 361 of FIG. 11) may include one or more openings through the top portion 260 of the golf club head 100 (e.g., one or more holes, slots, or slits) and extending in one or more directions of the interior roof structure 361 (e.g., radially, diagonally, or longitudinally between the toc portion 220 and the heel portion 230, longitudinally between the front portion 240 and the rear portion 250). In another example, the interior roof structure 361 may include one or more grooves or channels extending in one or more directions of the interior roof structure 361 (e.g., radially, diagonally, or longitudinally between the toe portion 220 and the heel portion 230, longitudinally between the front portion 240 and the rear portion 250). In another example, the interior roof structure 361 may include one or more ribs, projections, protrusions, or ridges extending in one or more directions of the interior roof structure 361 (e.g., radially, diagonally, or longitudinally between the toc portion 220 and the heel portion 230, longitudinally between the front portion 240 and the rear portion 250). In another example, the interior roof structure may include a plurality of perforations or holes through which a golf ball that is retained in the retention cavity 340 may be visible. In another example, the interior roof structure may include a mesh structure through which a golf ball that is retained in the retention cavity 340 may be visible. In yet another example, the interior roof structure may be constructed from a transparent or semi-transparent material such as plexiglass through which a golf ball that is retained in the retention cavity 340 may be visible. The interior roof structure 361 may include one or more openings only, one or more grooves only, one or more ribs only, or one or more of any combination of openings, grooves, or ribs. The interior roof structure 361 may include one or more openings, grooves, or ribs forming various configurations (e.g., a U-shape, a V-shape, a web shape, hexagonal shapes to form a honeycomb cell pattern, etc.). The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cc. In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled." and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent." "close." "immediate," "nearby," "neighboring." etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods, and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a toe portion, a heel portion, a front portion, a rear portion, a top portion, and a sole portion; and a cavity located at the sole portion and defining a space extending into the body portion, the cavity having an opening and two or more ball retention areas configured to frictionally engage at least a portion of a golf ball within the retention cavity, wherein the two or more ball retention areas frictionally engage the portion of the golf ball along a ball circumference located above an equator of the golf ball at a distance greater than or equal to 0.050 inch (0.127 centimeters) and less than or equal to 0.070 inch (0.178 centimeters).

2. A golf club head as defined in claim 1, wherein at least one of the two or more ball retention areas includes a rounded edge located at the opening.

3. A golf club head as defined in claim 1, wherein the two or more ball retention areas include two ball retention areas disposed opposite each other and separated by a distance less than or equal to 1.680 inches (4.268 cm).

4. A golf club head as defined in claim 1, wherein the cavity further comprises a roof structure configured to decrease in height in a front-to-rear direction of the golf club head and increase in height toward a center longitudinal plane of the golf club head from both a heel-side direction and a toe-side direction of the golf club head.

5. A golf club head as defined in claim 1, wherein the two or more ball retention areas include two ball retention areas disposed adjacent each other, wherein the retention cavity further comprises a relief gap located between the two adjacent ball retention areas, and wherein the relief gap enables the golf ball to be dislodged from the retention cavity.

6. A golf club head as defined in claim 1, wherein the cavity is concealed when the golf club head is viewed directly from the top portion.

7. A golf club head as defined in claim 1, wherein the opening has a polygonal shape.

8. A golf club head comprising:

a body portion having a sole portion; and a cavity located at the sole portion and defining a space extending into the body portion, the cavity having an opening, a first pair of opposing interior side walls separated by a first distance, and a second pair of opposing interior side walls separated by a second distance, wherein the first distance is less than the second distance, wherein the first pair of opposing interior side walls are configured to frictionally engage at least a portion of a golf ball within the cavity, wherein the first distance is less than or equal to 1.680 inches (4.268 cm); and wherein the first pair of opposing interior side walls frictionally engage the golf ball along a ball circumference located above an equator of the golf ball at a distance greater than or equal to 0.050 inch (0.127 centimeters) and less than or equal to 0.070 inch (0.178 centimeters).

9. A golf club head as defined in claim 8, wherein the second distance is greater than 1.680 inches (4.268 cm).

10. A golf club head as defined in claim 8, wherein the opening has a polygonal shape.

11. A golf club head as defined in claim 8, wherein the first distance separating the first pair of opposing interior side walls is measured at or proximate the opening, and wherein the first pair of opposing interior side walls are slanted such that the first distance decreases in a sole-to-top direction of the golf club head.

12. A golf club head as defined in claim 8, wherein the second distance separating the second pair of opposing interior side walls is measured at or proximate the opening, and wherein the second pair of opposing interior side walls are slanted such that the second distance decreases in a sole-to-top direction of the golf club head.

13. A golf club head as defined in claim 8, wherein the cavity is concealed when the golf club head is viewed directly from the top portion.

14. A golf club head comprising:

a body portion having a sole portion; and a cavity located at the sole portion and defining a space extending into the body portion, the cavity having an opening and a plurality of interior side walls, wherein a first portion of the plurality of interior side walls are configured to frictionally engage at least a portion of a golf ball within the cavity, wherein a second portion of the plurality of interior side walls are spaced apart from the golf ball when at least a portion of the golf ball is retained by the cavity, and wherein the first portion of the plurality of interior side walls frictionally engage the portion of the golf ball above an equator of the golf ball.

15. A golf club head as defined in claim 14, wherein the plurality of interior side walls are disposed to alternate about the opening between interior side walls that frictionally engage the golf ball and interior side walls that are spaced apart from the golf ball.

16. A golf club head as defined in claim 14, wherein two interior side walls of the first portion of the plurality of interior side walls are located opposite each other, wherein a distance between the two interior side walls of the first portion of the plurality of interior side walls is greater than or equal to 1.620 inches (4.115 centimeters) and less than or equal to 1.670 inches (4.242 centimeters), and wherein the distance is measured at or proximate the opening.

17. A golf club head as defined in claim 14, wherein two interior side walls of the second portion of the plurality of interior side walls are located opposite each other, wherein a distance between the two interior side walls of the second portion of the plurality of interior side walls is greater than or equal to 1.800 inches (4.572 centimeters) and less than or equal to 2.000 inches (5.080 centimeters).

18. A golf club head as defined in claim 14, wherein each interior side wall of the first portion of the plurality of interior side walls includes a rounded edge located at the opening and configured to increase a ball contact area of each interior side wall of the first portion of the plurality of interior side walls, and wherein the cavity is configured to retain less than 50% of a total volume of the golf ball within the cavity.

19. A golf club head as defined in claim 14, wherein the first portion of the plurality of interior side walls frictionally engage the golf ball along a ball circumference located above the equator of the golf ball at a distance greater than or equal to 0.050 inch (0.127 centimeters) and less than or equal to 0.070 inch (0.178 centimeters).

20. A golf club head as defined in claim 14, wherein the first and second portions of the plurality of interior side walls are equal in number.

* * * * *